US009366042B2

(12) United States Patent
Weston

(10) Patent No.: US 9,366,042 B2
(45) Date of Patent: Jun. 14, 2016

(54) GUARDRAIL FOR AN ELEVATED WORKING PLATFORM

(75) Inventor: Richard Weston, Essex (GB)

(73) Assignee: TELETOWER.COM LIMITED, Fermanagh (GB)

( * ) Notice: Subject to any disclaimer, the term of this patent is extended or adjusted under 35 U.S.C. 154(b) by 0 days.

(21) Appl. No.: 13/982,849

(22) PCT Filed: Jan. 24, 2012

(86) PCT No.: PCT/IB2012/050331

§ 371 (c)(1),
(2), (4) Date: Oct. 8, 2013

(87) PCT Pub. No.: WO2012/104748

PCT Pub. Date: Aug. 9, 2012

(65) Prior Publication Data

US 2014/0020978 A1 Jan. 23, 2014

(30) Foreign Application Priority Data

Feb. 1, 2011 (GB) ..... 1101724.1

(51) Int. Cl.
*E06C 7/16* (2006.01)
*E04G 5/14* (2006.01)
(Continued)

(52) U.S. Cl.
CPC .. *E04G 5/14* (2013.01); *E04G 1/30* (2013.01); *E04G 1/34* (2013.01)

(58) Field of Classification Search
CPC ..... E04G 7/00; E04G 1/14; E04G 1/28; E04G 1/30; E04G 5/14; E04G 5/147; E04G 5/16; E06C 1/10
USPC ..... 182/120, 121, 178, 178.1–178.6, 103, 182/69.4, 112, 113, 152, 186.7; 312/265.5; 24/573.11
See application file for complete search history.

(56) References Cited

U.S. PATENT DOCUMENTS 3,017,968 A * 1/1962 McMahon ..... 182/141
3,190,406 A * 6/1965 Usher et al. ..... 52/646
(Continued)

FOREIGN PATENT DOCUMENTS

DE 295 04 891 6/1995
EP 1 679 408 7/2006
(Continued)

OTHER PUBLICATIONS

International Search Report on PCT/IB2012/050331, mailed May 11, 2012.

*Primary Examiner* — Alvin Chin-Shue
*Assistant Examiner* — Shiref Mekhaeil
(74) *Attorney, Agent, or Firm* — Foley & Lardner LLP

(57) ABSTRACT

A collapsible structure is described that can be erected to provide an elevated working platform having two ends and two sides. Two telescopically collapsible ladder frames (10, 12) are disposed above the level of the platform, one on each end of the platform. Each ladder frame (10, 12) is formed of two stiles (20, 22) having telescopically collapsible sections, rungs each extending between respective sections of the two stiles and latch mechanisms for locking the stile sections in the extended position of the ladder frame. Each of the ladder frames (10, 12) further incorporates a guardrail (30, 32) that lies parallel to the rungs (24) when the ladder frame is collapsed. The guardrail (30, 32) is mounted for rotation about a first stile and releasably secured to the second stile. After release from the second stile of the same ladder frame and rotation about the first stile each guardrail is connectable to the second stile of the other ladder frame to lie parallel to a side of the platform.

7 Claims, 1 Drawing Sheet

(51) Int. Cl.
*E04G 1/34* (2006.01)
*E04G 1/30* (2006.01)

(56) References Cited

U.S. PATENT DOCUMENTS 3,214,948 A * 11/1965 Modrey ..... 70/99
RE26,215 E * 5/1967 Usher et al. ..... 52/646
RE26,703 E * 11/1969 McCarthy ..... 24/573.11
4,064,999 A * 12/1977 Young ..... 414/11
4,451,072 A * 5/1984 Petty, Sr. ..... 292/128
4,883,147 A * 11/1989 Davison et al. ..... 182/186.8
5,022,199 A * 6/1991 Horii et al. ..... 52/123.1
5,086,875 A * 2/1992 Shreve, III ..... 182/152
5,099,953 A * 3/1992 Stegath ..... 182/152
5,533,593 A * 7/1996 Huang ..... 182/141
5,555,954 A * 9/1996 Swiderski ..... 182/152
5,988,317 A * 11/1999 Riding ..... 182/152
6,953,106 B2 * 10/2005 Weston et al. ..... 182/115
8,210,312 B1 * 7/2012 Tetreault, Jr. ..... 182/119
2004/0050621 A1 * 3/2004 Masino et al. ..... 182/178.5
2010/0133041 A1 * 6/2010 Wang ..... 182/108
2013/0126270 A1 * 5/2013 Darby ..... 182/113

FOREIGN PATENT DOCUMENTS

GB 2 189 536 10/1987
WO WO-02/099225 12/2002

* cited by examiner

GUARDRAIL FOR AN ELEVATED WORKING PLATFORM

CROSS-REFERENCE TO RELATED APPLICATIONS

The present application claims the benefit as a national stage of International Application Serial No. PCT/IB2012/050331, filed on Jan. 24, 2012, which claims the benefit of Great Britain application 1101724.1, filed Feb. 1, 2011, the entire disclosures of which are incorporated herein by reference for any and all purposes as if fully set forth herein.

FIELD OF THE INVENTION

The present invention relates to a guardrail for an elevated working platform of a telescopically collapsible structure.

BACKGROUND OF THE INVENTION

EP 1392940 discloses a collapsible scaffolding tower having an elevated working platform. There has also previously been proposed a podium in which a working platform is pivotably connected to the tops of two ladders, that may be telescopically collapsible and are used to climb onto the platform. To meet safety requirements and regulations, any such elevated working platform needs to be surrounded by guardrails.

In EP 1392940, the scaffolding tower consists of two telescopically collapsible ladder frames that are connected to one another by suitable stays and braces and the ends of the elevated working platform rest on two opposed rungs. In such a construction, the rungs of the ladder frames that are higher than the working platform can act as guardrails on two sides of the tower but at least two further guardrails are required at the front and the back of the tower.

Similarly, in the case of a podium, it has been proposed to provide two short collapsible ladder frames, one at each end of the platform, that can be pivoted to lie parallel to the platform. The rungs of these ladder frames can serve as guardrails at the ends of the platform but once again two further guardrails are required at the front and the back of the podium.

OBJECT OF THE INVENTION

The present invention seeks to provide a collapsible structure that affords adequate protection to a person standing on an elevated platform yet does not require guardrails to be stored and transported separately from the collapsible structure.

SUMMARY OF THE INVENTION

In accordance with the present invention, there is provided a collapsible structure that can be erected to provide an elevated working platform having two ends and two sides, wherein two telescopically collapsible ladder frames are disposed above the level of the platform, one on each end of the platform, each ladder frame being formed of two stiles having telescopically collapsible sections, rungs each extending between respective sections of the two stiles and latch mechanisms for locking the stile sections in the extended position of the ladder frame, wherein each of the ladder frames incorporates a guardrail that lies parallel to the rungs when the ladder frame is collapsed, the guardrail being mounted for rotation about a first stile and releasably secured to the second stile, and wherein the guardrail after release from the second stile of the same ladder frame and rotation about the first stile is connectable to the second stile of the other ladder frame to lie parallel to a side of the platform.

In accordance with a second aspect of the invention, there is provided a collapsible structure that can be erected to provide an elevated working platform having two ends and two sides, wherein two telescopically collapsible ladder frames are disposed above the level of the platform, one on each end of the platform, each ladder frame being formed of two stiles having telescopically collapsible sections, rungs each extending between respective sections of the two stiles and latch mechanisms for locking the stile sections in the extended position of the ladder frame, wherein each of the ladder frames incorporates two guardrail parts each rotatable about a respective one of the stiles of the ladder frame, the guardrail parts lying parallel to the rungs when the ladder frame is collapsed and being releasably connected to one another, and wherein each of the guardrail parts, after release from the other guardrail part mounted on the same ladder frame and rotation about the ladder frame stile is releasably connectable to a guardrail part mounted on the other ladder frame to form a guardrail extending parallel to a side of the platform.

BRIEF DESCRIPTION OF THE DRAWINGS

The invention will now be described further, by way of example, with reference to the accompanying drawings, in which.

DETAILED DESCRIPTION OF THE PREFERRED EMBODIMENT(S)

Figure 1:
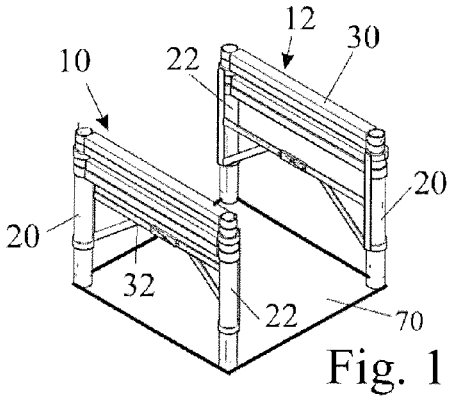
FIG. 1 shows two collapsed ladder frames for positioning one at each end of a raised platform to provide hand and knee level guardrails all round the platform.
Figure 4:
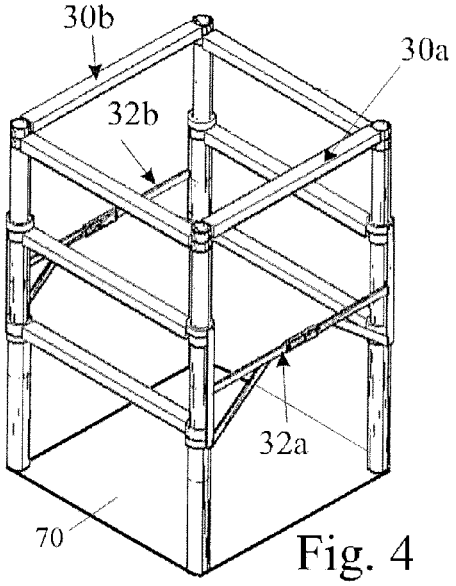

FIG. 1 shows two ladder frames 10 and 12 in their collapsed or storage state. The two ladder frames are intended to be located at opposite ends of a raised platform 70. The raised platform may be the platform of a scaffolding tower, as described in EP 1392940, or it may form part of a podium. In the case of a scaffolding, the platform may rest on a collapsible frame incorporating the two ladder frames 10 and 12. In the case of a podium, the platform is permanently pivotably connected to two support ladders that can collapse for storage under the platform whereas the two illustrated ladder frames 10 and 12 may be similarly connected to the platform to fold away above the platform. When fully erected, as shown in FIG. 4, the ladder frames 10 and 12 provide a secure cage surrounding the platform on all sides with guardrails at both waist height and knee height.

Each of the ladder frames 10 and 12 includes two stiles 20 and 22, made up of telescopically collapsible tubular sections labelled 20*a*, 20*b*, 20*c* and 22*a*, 22*b*, 22*c* of progressively smaller diameter. Rungs 24*a*, 24*b* and 24*c* extend between and are mounted on respective pairs of sections 20*a*, 22*a*; 20*b*, 22*b*; and 20*c*, 22*c*. When the ladder frames 10 and 12 are extended, the rungs 24*a* to 24*c* themselves serve as guardrails at the opposite ends of the raised platform.

In addition, each of the two ladder frames 10 and 12 includes components for erecting two further guardrails 30*a* and 30*b* arranged at waist height to serve as handrails and two still further guardrails 32*a* and 32*b* arranged at knee height to serve as knee rails. When deployed, these further guardrails 30 and 32 lie parallel to the sides of the raised platform, i.e. perpendicular to the planes containing the rungs of the two ladder frames 10 and 12.

It is important to note that all components of the guardrails 30 and 32, when collapsed, lie in the planes of the rungs of the ladder frames so that they may be stored neatly and no further separately stored components are required for their assembly.

Figure 2:
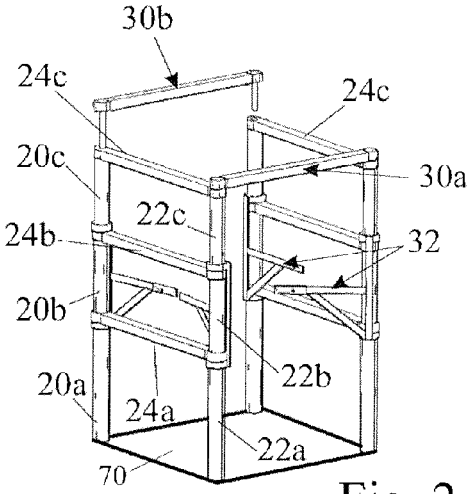
FIGS. 2 to 4 show different stages in the deployment of the guardrails of the ladder frames shown in FIG. 1, and FIGS. 5 and 6 show sections through a releasable latch for locking a guardrail to a latch pin secured to one of the stiles of the ladder frames.
Figure 3:
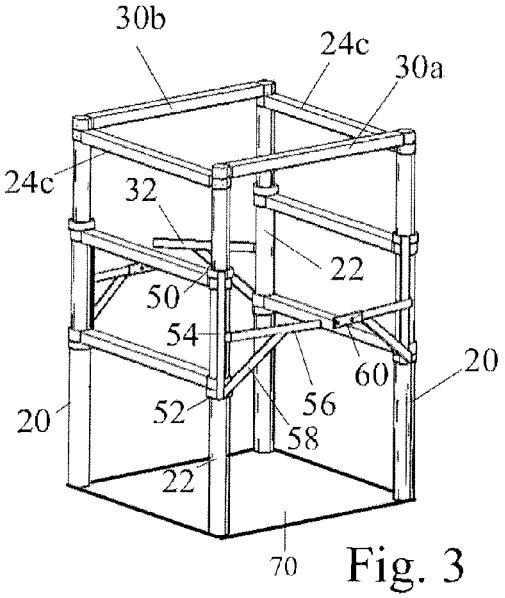

The handrails 30 and knee rails 32 are constructed differently from each other on account of their location. In the case of the handrails 30*a* and 30*b*, each is connected at its opposite ends to two tubes that are of a diameter to fit snugly in the uppermost stile sections 20*c* and 22*c*. In FIGS. 1-4, the two handrails 30*a* and 30*b* lie above the top rungs 24*c* of the respective ladder frames and the tubes of each handrail 30*a* and 30*b* are received in the top sections 20*c* and 22*c* of the same ladder frame 10 or 12. As shown in FIG. 2, the handrails 30*a* and 30*b* can be pulled out of the upper sections 20*c*, 22*c* of the ladder frame on which they are stored and reinserted into the stiles after rotation through ninety degrees. Thus, one of the tubes of the handrail 30*a* or 30*b* is received in the top stile section 22*c* of the ladder frame 10 while its other tube is received in the top stile section 20*c* of the ladder frame 12. The handrails 30*a* and 30*b* are in this way used to connect the two ladder frames 10 and 12 to one another to form a stable self-supporting framework.

It is preferred for one of the tubes connected to the handrails 30*a* and 30*b* to be longer than the other and to provide a stop collar on the longer tube so that it cannot be separated from its associated ladder frame, in the same way as the stile sections are prevented from separating from one another. Deployment of each handrail 30*a* and 30*b* can thus be carried out by simply raising the handrail 30*a* or 30*b* until its shorter end separates from the associated stile, rotating it by 90° then lowering the shorter tube into the stile of the other ladder frame.

Figure 5:
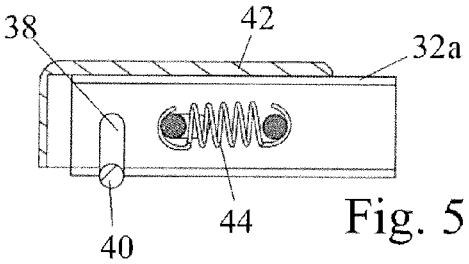
Figure 6:
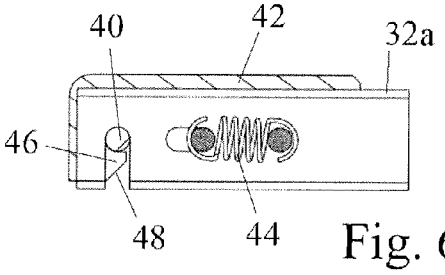

This method of coupling the ends of the handrails 30*a* and 30*b* to the stiles cannot be used for the knee rails 32*a* and 32*b* that are at knee height. One end of each knee rail 32*a* and 32*b*, is pivotably connected to a collar that can rotate about one of the stiles 20, while the other end is releasably connected to the other stile 22. FIGS. 5 and 6 show sections through a releasable latch for locking the knee rail 32*a* to a latch pin 40 that forms part of the collar.

The knee rail 32*a* in FIGS. 5 and 6 is pivotable at one end about an axis normal to the plane of the drawing and is formed with a slot 38 near its illustrated opposite end. The slot 38 can receive a latch pin 40 that forms part of the collar mounted on the opposite stile of the ladder frame. A sleeve 42 is slidable over the end of the knee rail 32*a* and is biased into the locking position shown in FIG. 6 by a spring 44. In this position a tongue 46 of the sleeve 42 engages under the latch pin 40 and prevents it from slipping out of the slot 38, thereby securing the knee rail 32*a* to the opposite collar. When the sleeve 42 is urged to the left, as viewed in FIG. 5, the latch pin 40 is no longer obstructed by the tongue 46 and the knee rail 32*a* may be rotated clockwise to release it from the collar.

The tongue 46 has a ramped surface 48 so that the engagement of the pin 40 with the tongue 46 moves the sleeve 42 to the left. Thus, operation of the latch is automatic when the knee rail 32*a* is lowered onto the latch pin 40. Release of the latch, however, requires the sleeve 42 to be moved towards the opposite stile. An unstable person standing on the platform and gripping the sleeve 42 accidentally to steady himself would attempt to pull the sleeve 42 away from the direction of the adjacent stile and would not therefore unintentionally unlatch the guardrail.

FIGS. 1 to 4 show knee rails 32*a* and 32*b* that are formed of two similar parts. Each part comprises a first collar 50 located above the rung 24*b* and slidable relative to the stile section 22*c* and a second collar 52 disposed between the rung 24*a* and slidable over the stile section 22*a*. A bar 54 extends between the two collars 50 and 52 and carries guardrail half 56 and an inclined brace 58 to form a rigid gate leg assembly. The gate leg assemblies on opposite stiles can be connected to one another by a sliding sleeve 60. Preferably, permanent magnets in the sleeve 60 and in the guardrail halves 56 hold the sleeve in the locked position in which it overlies the ends of both gate leg assemblies.

In FIG. 2, the gate leg assemblies on the same ladder structure are connected to one another, resulting in the guardrails resting parallel to the rungs 24, whereas in FIG. 4, the gate assemblies are rotated through 90° and connected to one another with the guardrails extending parallel to the sides of the platform.

The invention claimed is:

1. A collapsible structure configured to be erected on an elevated working platform having two ends and two sides, the collapsible structure comprising:

a first telescopically collapsible ladder frame;

a second telescopically collapsible ladder frame, wherein each of the first and second telescopically collapsible ladder frames comprises a first stile and a second stile, each of the first and second stiles having telescopically collapsible sections, a plurality of rungs, each rung extending between a telescopically collapsible section of the first stile and a corresponding telescopically collapsible section of the second stile, and a plurality of latch mechanisms configured for locking the telescopically collapsible sections of each of the first and second stiles in an extended position of the first and second ladder frames; and a guardrail mounted for rotation about a longitudinal axis of the first stile, wherein the guardrail is selectively movable between a first position in which the guardrail is releasably secured to the second stile of one of the first and second ladder frames to which the guardrail is mounted such that the guardrail lies parallel to the rungs of the first and second ladder frames, and a second position in which the guardrail is releasably secured to the second stile of the other of the first and second ladder frames to which the guardrail is not mounted such that the guardrail lies perpendicular to the rungs of the first and second ladder frames, and wherein the guardrail is connected to two tubes, each tube being slidably received in an uppermost section of a respective stile of the first and second ladder frames.

2. The collapsible structure as claimed in claim 1, wherein, when deployed, the guardrail is configured to be arranged at a first predetermined height above a platform to serve as a handrail.

3. The collapsible structure as claimed in claim 1, wherein when the collapsible structure is erected on an elevated working platform, the first ladder frame is configured to be located at one of the two ends of the platform and the second ladder frame is configured to be located at the other of the two ends of the platform.

4. A collapsible structure configured to be erected on an elevated working platform having two ends and two sides, the collapsible structure comprising:

a first telescopically collapsible ladder frame;

a second telescopically collapsible ladder frame, wherein each of the first and second telescopically collapsible ladder frames comprises a first stile and a second stile, each of the first and second stiles having telescopically collapsible sections, a plurality of rungs, each rung extending between a telescopically collapsible section of the first stile and a corresponding telescopically collapsible section of the second stile, and a plurality of latch mechanisms configured for locking the telescopically collapsible sections of each of the first and second stiles in an extended position of the first and second ladder frames; and a guardrail mounted for rotation about a longitudinal axis of the first stile, wherein the guardrail is selectively movable between a first position in which the guardrail is releasably secured to the second stile of one of the first and second ladder frames to which the guardrail is mounted such that the guardrail lies parallel to the rungs of the first and second ladder frames, and a second position in which the guardrail is releasably secured to the second stile of the other of the first and second ladder frames to which the guardrail is not mounted such that the guardrail lies perpendicular to the rungs of the first and second ladder frames, wherein the guardrail is connected to two tubes, each tube being slidably received in an uppermost section of a respective stile of the first and second ladder frames, and wherein the two tubes connected to the guardrail are of unequal length, wherein a shorter of the two tubes is configured to be disengaged from the second stile of the one of the first and second ladder frames to which the guardrail is mounted, while a longer of the two tubes remains engaged within the first stile of the one of the first and second ladder frames to which the guardrail is mounted, so as to permit the guardrail to rotate about the longitudinal axis of the first stile of the one of the first and second ladder frames to which the guardrail is mounted.

5. A collapsible structure configured to be erected on an elevated working platform having two ends and two sides, the collapsible structure comprising:

a first telescopically collapsible ladder frame;

a second telescopically collapsible ladder frame, wherein each of the first and second telescopically collapsible ladder frames comprises a first stile and a second stile, each of the first and second stiles having telescopically collapsible sections, a plurality of rungs, each rung extending between a telescopically collapsible section of the first stile and a corresponding telescopically collapsible section of the second stile, and a plurality of latch mechanisms configured for locking the telescopically collapsible sections of each of the first and second stiles in an extended position of the first and second ladder frames; and a guardrail mounted for rotation about a longitudinal axis of the first stile, wherein the guardrail is selectively movable between a first position in which the guardrail is releasably secured to the second stile of one of the first and second ladder frames to which the guardrail is mounted such that the guardrail lies parallel to the rungs of the first and second ladder frames, and a second position in which the guardrail is releasably secured to the second stile of the other of the first and second ladder frames to which the guardrail is not mounted such that the guardrail lies perpendicular to the rungs of the first and second ladder frames, wherein the guardrail has a first end secured to a first collar rotatably secured to the first stile of the one of the first and second ladder frames to which the guardrail is mounted, and a second end configured to releasably secure to the second stile of each of the first and second ladder frames by a releasable latch, and wherein the releasable latch comprises a latch pin that forms part of a second collar mounted on the second stile, a slot in the end of the guardrail configured to receive the latch pin and a sleeve slidably mounted on the end of the guardrail and having a tongue operative when in a locking position to prevent the latch pin from escaping from the slot.

6. The collapsible structure as claimed in claim 5, wherein the sleeve is spring biased to urge the tongue into the locking position, and wherein the tongue has a ramped surface configured to cause the sleeve to retract automatically against an action of the spring when engaged by the latch pin.

7. The collapsible structure as claimed in claim 6, wherein an orientation of the tongue is such that release of the latch pin is effected by sliding the sleeve along the guardrail towards the second collar.

* * * * *